United States Patent [19]

Roy

[11] 4,443,738

[45] Apr. 17, 1984

[54] FLUORESCENT LAMP HAVING SUPPORT WIRES MADE WITH AUSTENITIC STEEL

[75] Inventor: Ashutosh Roy, London, England

[73] Assignee: THORN EMI plc, London, England

[21] Appl. No.: 396,381

[22] Filed: Jul. 8, 1982

[30] Foreign Application Priority Data

Jul. 10, 1981 [GB] United Kingdom ..... 8121308

[51] Int. Cl.[3] ..... H01J 1/62; H01J 5/50; H01J 5/00

[52] U.S. Cl. ..... 313/491; 313/332; 174/50.52

[58] Field of Search ..... 313/493, 491, 285, 332, 313/631, 633; 174/50.52; 252/502, 503

[56] References Cited

U.S. PATENT DOCUMENTS 2,716,714 8/1955 Adams et al. ..... 313/332 X

FOREIGN PATENT DOCUMENTS 1589473 5/1981 United Kingdom ..... 313/491

*Primary Examiner*—Palmer C. Demeo
*Assistant Examiner*—Sandra L. O'Shea
*Attorney, Agent, or Firm*—Fleit, Jacobson, Cohn & Price

[57] ABSTRACT

In a fluorescent lamp electrode assembly a coil electrode is supported on lead wires sealed in a glass flare. It has been found that during on-off switching cycles distortion occurs in the lead wires. To solve this it is proposed to make the lead wires, at least in the region of the electrodes, of single phase material, specifically austenitic steel. If difficulties are presented of matching coefficients of expansion of lead wires and flare the inner parts of the lead wires only may be of that material using a multi part welded structure in which the other parts are of, say, nickel-iron alloy or dumet.

8 Claims, 4 Drawing Figures

FLUORESCENT LAMP HAVING SUPPORT WIRES MADE WITH AUSTENITIC STEEL

This invention is related to electrical discharge lamps and is especially related to mount-assemblies for electrodes, in particular in fluorescent lamps.

In general discharge lamps of the fluorescent type have electrodes which comprise tungsten coils carrying a suitable electron-emissive material, each such coil being carried by two metal supports or leadwires to which it is clamped. The supports for the coil are embedded and sealed in a glass flare which is itself sealed into one end of the lamp tube. To obtain a satisfactory and reliable seal it is desirable for the lead wires to match the material of the glass flare, particularly with respect to thermal expansion. Commonly this is achieved by the use of composite "Dumet" supports sealed into lead glass mounts but other materials have been proposed.

It has been found that in fluorescent lamp electrodes distortion can arise in the support structure, particularly in the clamp whereby the filament is fixed to the supports, in the course of the lamp's on-off switching cycles.

It is an object of this invention to provide in a discharge lamp a mount assembly for which this problem is reduced.

According to the present invention there is provided a fluorescent lamp comprising a tubular light-transmitting envelope, coil electrodes at opposite ends of the envelope and respective electrode support assemblies at said ends of the envelope, each assembly comprising a glass flare sealed into the envelope to form an end wall thereof and electrode support wires extending through and sealed in the flare, the support wires, at least in the regions thereof adjacent the electrode, being formed of an austenitic steel maintaining its austenitic microstructure at the operating temperature of said regions when the lamp is in use.

The invention also embraces an electrode assembly for such a lamp.

Figure 1:
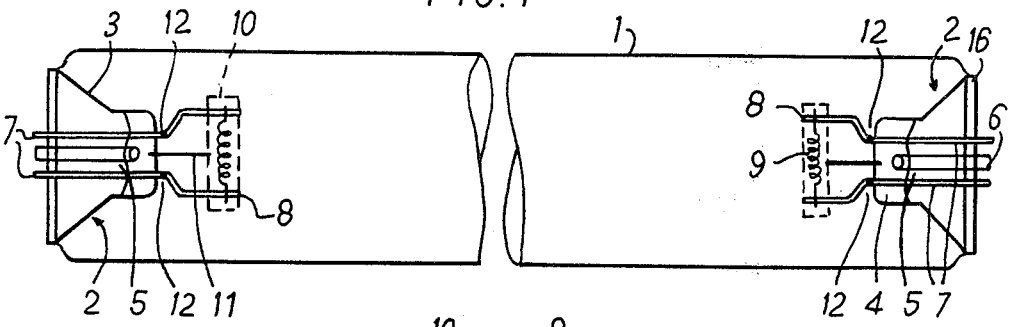
Figure 2:
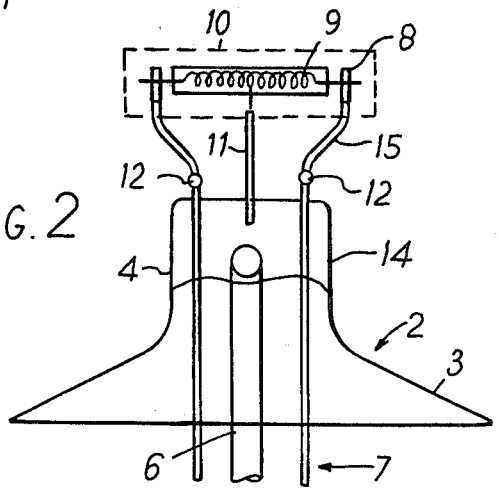
Figure 3:
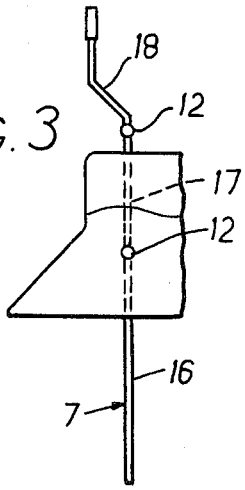
Figure 4:
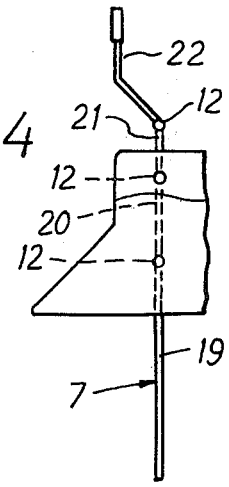

In order that the invention may be clearly understood and readily carried into effect it will be described by way of example with reference to the accompanying drawings of which:

FIG. 1 shows a fluorescent lamp having support wires for the electrodes in accordance with the invention, FIG. 2 shows an electrode assembly for a fluorescent lamp in which the electrode support wires are of a two part structure, FIG. 3 shows part of an electrode assembly in which a support wire has a three part structure, and FIG. 4 shows part of an electrode assembly in which a support wire has a four part structure.

The fluorescent lamp shown in FIG. 1 has a glass discharge tube 1 (coated with fluorescent material) and into each end of which there is sealed a glass flare 2. The glass flares are circular in cross-section and comprise a hollow frusto-conical portion 3 which at its smaller end is integral with a solid parallel-sided portion 4 known as a pinch on the same axis as portion 3. The larger ends of portion 3 are sealed into the ends of the glass tube 1.

Either or both (as shown in FIG. 1) of the flares 2 may be provided with an axial bore 5 which extends from the outer end thereof as a tubulation 6. The lamp may be exhausted through the tubulation 6 and mercury and the required gas or gas mixture may be introduced before the bore or bores 5 are closed at their inner end or ends, thereby sealing the lamp.

Passing through and sealed into each glass flare 2 is a pair of support or lead wires 7 which extend generally parallel to the axis of the flare and project from the inner end. At the inner end of each leadwire is an inner support clamp portion 8, and an electrode in the form of a coated coil 9 is held between the clamps 8, the coil being substantially perpendicular to the axis of the lamp.

The coil 9 is surrounded by a floating shield 10 held in place by a support 11, which is itself attached to the glass flare 2.

As discussed hereinbefore it has been found that during the on-off switching cycle of lamps such as that shown in FIG. 2, distortion occurs in the leadwires and particularly at the clamps 8.

It has now been found that unexpectedly the distortion results from the use for the leadwires of alpha and gamma phase materials. That is to say the use of materials of double phase crystal microstructure which tend to expand and contract during the switching cycle which causes distortion in the assembly.

To solve the problem it is now proposed to make the leadwires at least in the critical regions, of a single phase (austenitic) steel which maintains its single phase microstructure throughout the operating temperature range of the relevant parts.

It will be appreciated that the material of which the leadwire is made should match the glass of the flare in thermal expansion, at least at the point at which it passes therethrough. For flare materials such as soda-lime or lead oxide glass this will require an appropriate construction in which the glass and austenitic steel are separated.

A convenient answer to this practical restriction is to use a technique, in which each leadwire is made of one or more parts which may conveniently be of different material. Such a technique is described and claimed in British Pat. No. 1589473.

One example of such a structure is shown in FIG. 1 and in more detail in FIG. 2 which is a detail view of one flare with the leadwires and filament coil supported thereby. In this figure it can be seen that each leadwire 7 has, joined by welds 12, a portion 14, extending through the flare 2 and into the space within the lamp, and a portion 15 welded to the inner end of the portion 14. The portion 15 which is made of austenitic stainless steel may extend for varied distances along the leadwire 7 from the support clamp 8 up to a point immediately adjacent, but not in contact with, the glass of the flare 2. The portion 14 is then made of a material suitable for the glass of the flare, for example a nickel-iron alloy having an appropriate coefficient of expansion for a soda-lime or lead glass flare.

Structures having leadwires in more parts may be used and for example FIGS. 3 and 4 show leadwires of respectively three parts 16, 17 and 18 and four parts 19, 20, 21 and 22 welded as necessary at points indicated generally by the numeral 12. The three part arrangement is preferred.

In each case the inner part 18 and 22 respectively, is of the said austenitic steel. In FIG. 3 the portion 17 sealed into the flare is of nickel-iron alloy or Dumet while the outer portion 16 is of Copper plated mild steel (copper clad). In FIG. 4 the portion 20 sealed into the flare is made of Dumet and connects a portion 21 made of a suitable nickel iron alloy (preferably 48% nickel) with an outer portion 19 made of Copper clad. These arrangements are as described in the said Pat. No. 1589473 except for the inner sections of austenitic stainless steel.

For these sections the preferred material is austenitic stainless steel. There are forty varieties of austenitic stainless steel of which at present only three have been tested and these are, identified by their British Standard (BS) numbers: 304; 305; and 316.

BS 316 steel is preferred because it does not exhibit any ferritic properties (which are undesirable for this application) whereas BS 305 is slightly cheaper but is still suitable. BS 304 steel is the cheapest but may show excessive ferritic properties for some purposes and therefore should be tested for the appropriate application before use. Other austenitic steels not tested are potentially suitable but should be tested for the particular application bearing in mind the requirement to maintain austenitic microstructure at the operating temperature.

It should be noted that these steels may be obtained as normal carbon content and extra low carbon content (ELC) steel the latter being considered to be more suitable, so that BS 316 (ELC) steel is preferred.

Other embodiments of the invention employing different materials will be apparent to those skilled in the art bearing in mind the considerations explained hereinbefore.

What I claim is:

1. A fluorescent lamp comprising a tubular light-transmitting envelope, coil electrodes at opposite ends of the envelope and resepctive electrode support assemblies at said ends of the envelope, each assembly comprising a glass flare sealed into the envelope to form an end wall thereof and electrode support wires extending through and sealed in the flare, the support wires at least in the regions thereof adjacent the electrode, being formed of an austenitic steel maintaining its austenitic microstructure at the operating temperature of said regions when the lamp is in use.

2. A lamp according to claim 1 in which the support wires are each formed in at least two parts welded together, each part being of a material suitable to its purpose and the part closest to the electrode being of austenitic steel.

3. A lamp according to either claim 1 or claim 2 in which the support wires, at least in the regions thereof sealed in the flare, are formed of material having a coefficient of expansion matching that of the flare.

4. A lamp according to either claim 1 or claim 2 in which the austenitic steel is BS 316 stainless steel.

5. A lamp according to claim 4 in which the BS 316 steel is extra low carbon steel.

6. A lamp according to either claim 1 or claim 2 in which the austenitic metal is BS 305 stainless steel.

7. A lamp according to either claim 1 or claim 2 in which the austenitic steel is BS 304 ELC staninless steel.

8. An electrode assembly for a fluorescent lamp, the assembly comprising a glass flare, electrode support wires extending through and selaed into the flare and a coil electrode supported thereby, wherein the support wires, at least in the regions thereof adjacent the electrode, are formed of an austenitic steel chosen to maintain an austenitic microstructure at the operating temperature of said regions.

* * * * *